United States Patent [19]

Krause et al.

[11] 4,030,923

[45] June 21, 1977

[54] MIXTURE OF BINDER MATERIALS FOR USE IN CONNECTION WITH A CHARGE TRANSPORT LAYER IN A PHOTOCONDUCTOR

[75] Inventors: Donald Lester Krause, Boulder; Kenneth Dale Presley, Loveland, both of Colo.

[73] Assignee: International Business Machines Corporation, Armonk, N.Y.

[22] Filed: Dec. 11, 1975

[21] Appl. No.: 639,795

[52] U.S. Cl. ..... 96/1.5; 96/1.6; 252/501; 96/1 PC

[51] Int. Cl.[2] ..... G03G 5/04

[58] Field of Search ..... 96/1.5, 1.6, 1.7, 1.8; 252/501

[56] References Cited

UNITED STATES PATENTS

| | | | |
|---|---|---|---|
| 2,999,750 | 9/1961 | Miller | 96/1.8 |
| 3,347,670 | 10/1967 | Nelson et al. | 96/1.5 |
| 3,527,602 | 9/1970 | Fox et al. | 96/1.5 X |
| 3,824,099 | 7/1974 | Champ et al. | 96/1.5 |
| 3,837,851 | 9/1974 | Shattuck et al. | 96/1.6 X |
| 3,871,882 | 3/1975 | Wiedemann | 96/1.5 |
| 3,877,935 | 4/1975 | Regensburger et al. | 96/1.5 |

OTHER PUBLICATIONS

Brandrup et al., "Polymer Handbood", Wiley, 1966, p. IX–4.

*Primary Examiner*—David Klein
*Assistant Examiner*—Judson R. Hightower
*Attorney, Agent, or Firm*—William N. Hogg; Gidon Stern

[57] ABSTRACT

This invention relates to an improvement in photoconductive compositions of layered electrophotographic plates and related electrophotographic processes and particularly in the charge transport layer thereof which includes a tri-aryl pyrazoline compound in conjunction with a binder material wherein the improvement comprises the use of a tri-aryl pyrazoline compound and a mixture of binder materials comprising about 3 to 25% by weight acrylic resin and about 75 to 97% by weight polycarbonate.

12 Claims, No Drawings

MIXTURE OF BINDER MATERIALS FOR USE IN CONNECTION WITH A CHARGE TRANSPORT LAYER IN A PHOTOCONDUCTOR

BACKGROUND OF THE INVENTION

1. Field of the Invention

This invention relates to an improved binder formulation for use in conjunction with a tri-aryl pyrazoline compound in the charge transport layer of layered electrophotographic plates.

2. DESCRIPTION OF THE PRIOR ART

It is known in the art of electrophotography that in substantially all modern electrophotographic reproduction processes images are formed upon a photoconductive insulating surface by first subjecting the photoconductive surface to a uniform charge and thereafter selectively exposing the surface to light. Because of the nature of the photoconductive material, that portion of the surface which has been exposed to the light is rendered electrically conductive so as to cause the charge to dissipate in the illuminated areas and to leave behind an electrostatic latent image. The image so obtained is thereafter developed, or rendered visible, by any of a number of different means such as by contact with a developer, including a carrier and an electroscopic material known in the art as a "toner".

Various photographic imaging elements have been described in the patent literature which may be employed for the purpose of carrying out the foregoing phenomenon. In practice, the electrophotographic imaging element may be a homogeneous layer on a support or it may be a multi-layered structure including a layer of charge generating photoconductive material and layers of other materials. A substantial number of electrophotographic imaging elements including multiple layers are illustrated in the patent literature. For example, U.S. Pat. No. 3,041,166 discloses a layered structure consisting of an inorganic vitreous selenium photoconductor overlaid with an insulating photoconductive polymer. U.S. Pat. No. 3,165,405 discloses a structure designed for reflex imaging utilizing a two-layered zinc oxidebinder structure. U.S. Pat. No. 3,394,001 discloses an electrophotographic element including a conductive substrate carrying a photoconductive material being both underlaid and overlaid by an electron donor dye. U.S. Pat. No. 3,537,906 illustrates an electrophotographic element including photoconductive double layers containing an organic, photoconductive insulating layer between the substrate and photoconductive vapor deposited selenium. In U.S. Pat. No. 3,598,582 is described a composite photosensitive device adapted for reflex exposure which employs a layer of organic photoconductive particles arrayed on a supporting substrate and overcoated by a layer of organic charge transport material. More recently many patents have been issued which utilize a composite structure consisting of a conductive substrate, a charge generation layer and an organic charge transport layer as taught by U.S. Pat. No. 3,598,582. These include U.S. Pat. Nos. 3,713,820; 3,725,058; 3,824,099; 3,837,851; 3,839,034; 3,850,630 and 3,898,084.

It can therefore be seen that the patent literature has recognized that a particularly useful electrophotographic imaging element is a layered photoconductor which is composed of layers among which may be designated a charge transport layer, a charge generating layer and a conductive substrate. Thus, for example, in U.S. Pat. No. 3,837,851, where such a photoconductor is disclosed, it is acknowledged that while the theory underlying the discrete layered photoconductor is not known with certainty, it is believed that, for instance, in the situation where the charge transport layer is on top of the charge generating layer and the electrophotographic plate is thereby negatively charged with electrons, and because the charge transport layer has a very low absorbtivity in the light range in which the usual photocopies illuminate the photoconductor, the light which impinges on the surface of the photoconductor is transmitted through the charge transport layer to the charge generating layer. In response to exposure to the light which has been transmitted to it, the charge generating layer in turn is believed to generate responsively both holes and electrons. While the electrons are bled off through the conductive substrate, the holes from the charge generating layer are transported back through the charge transport layer to the surface where they combine with the electrons, the electrons not readily dissipating under dark conditions, so as to neutralize the surface charge. By exposure of the surface of the photoconductor in this manner, a remaining charge pattern is created which may thereafter be rendered visible.

It can therefore be seen that photoconductivity in the context of the layered photoconductor as described above, and as noted in U.S. Pat. No. 3,837,851, involves at least two steps: (1) the generation of a charge and (2) the transporation of a charge. As to the latter, U.S. Pat. No. 3,837,851 teaches that a charge transport layer which has been found to be particularly useful when used in conjunction with a separate charge generating layer is one which is formed from photoconductive pyrazoline compounds manifesting the following formula:

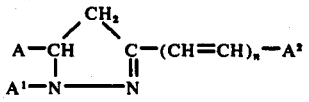

wherein n is zero or one, and A, $A^1$ and $A^2$ are each aryl radicals. It is further stated therein that it is preferred that n=1 in which case the materials may be classified chemically as styryl pyrazolines and that one or more of the aryl groups be substituted, most preferably with groups known in the art to be electron donating groups. The most preferred substituent groups are methoxy, ethoxy, dimethyl amino, diethyl amino and the like. When using the aforementioned pyrazoline compounds as the charge transport layer, it is known that although they are film forming and thus may be used alone to form the charge transport layer, it is generally preferred to use these compounds in conjunction with a binder material for the purpose of imparting mechanical strength to the charge transport layer.

While many binder materials, including various acrylic resins and polycarbonates, are known to be generally useful in photoconductor applications, for instance, as disclosed in U.S. Pat. Nos. 3,527,602, 3,549,362, 3,684,548 and 3,770,428, and notwithstanding that polycarbonates, polyester resins, polyvinylidene chloride and polystyrene are known to be useful individually as binder materials in layered photoconductors wherein a tri-aryl pyrazoline compound is employed as the charge transport layer, i.e., U.S. Pat.

No. 3,837,851, it has been observed that when the binder materials are used in a layered photoconductor comprising a conductive substrate, a charge generating layer and a charge transport layer as taught by the prior art, the resulting photoconductor, though possessing mechanical properties which are better than those where no binder material at all is used, nevertheless exhibits very serious disadvantages and drawbacks which makes such a photoconductor of very limited use in actual practice.

For instance, it has been observed that when only a polycarbonate binder material is employed in a tri-aryl pyrazoline charge transport layer, a film is formed upon the surface of the photoconductor. This film, which may for convenience be designated as "toner film,"is believed to be caused by the adherence of the toner material, used to render the latent electrostatic charge visible, to the surface of the photoconductor. The toner film so adhered upon the photoconductive surface is not readily cleaned off and brings about streaking in the photocopies. Such a film also brings about a loss of the required sensitivity as well as a quick decrease in the electrical characteristics of the photoconductor such that the number of useful copies obtainable from such a photoconductor is very limited. Further, and notwithstanding the admonition in the prior art that binder materials should be employed "for mechanical reasons,"as stated in U.S. Pat. No. 3,837,851, it has been observed that when only a polycarbonate is employed as the binder material, the surface of the photoconductor is very soft, is easily damaged and soon loses the smoothness necessary to yield good photocopies. In fact, the surface of the charge transport layer soon wears away after the production of only a relative few copies.

Similarly, it has been observed tht when only an acrylic resin binder is employed in a tri-aryl pyrazoline charge transport layer, a clear film is very quickly formed upon the surface of the photoconductor. Such a clear film, which may be analogized to a floor-wax film, is believed to be caused by adhered Teflon which is not easily removable from the surface of the photoconductor, the Teflon being deposited from both the brush used to clean the surface as well as from the toner carrier material. This clear film is as detrimental as the toner film formed by the adherence of the toner material, and, like the toner film, also results in a decrease in sensitivity and the concurrent limitation in the number of useful copies obtainable. It has also been observed that when an acrylic resin is so employed, streaks develop upon the photocopies. It is believed that the streaking is caused by a like streaking upon the surface of the photoconductor surface due to the clear film deposited thereon. Further, the use of an acrylic resin in the charge transport layer has been observed to render the surface very brittle and easily subject to cracking and breakage even under the normal and routine handling that such a photoconductor is subjected to.

Further, the aforementioned filming problems become even more acute as the temperature to which the photoconductive surface is exposed is elevated. It would therefore be desireable to not only be able to overcome the filming problems, but also to be able to deal more successfully with such filming at the elevated temperatures.

Accordingly, there is demonstrated a need for a binder formulation which is compatible for use with tri-aryl pyrazoline compounds in the charge transport layer of a layered photoconductor and which will overcome the aforementioned disadvantages. It is to a particular and improved binder formulation for use in conjunction with a layered photoconductor that the instant invention is directed.

SUMMARY OF THE INVENTION

It has been surprisingly discovered that one may overcome the aforementioned disadvantages and obtain improved photoconductive properties and improved mechanical properties in layered electrophotographic plates by employing in the charge transport layer thereof a mixture of binder materials comprising about 3 to 25% by weight acrylic resin and about 75 to 97% by weight polycarbonate.

The instant invention is also directed to a layered photoconductor which contains a charge generating layer, a charge transport layer as well as a conductive substrate and wherein the charge transport layer includes a tri-aryl pyrazoline compound and a mixture of binder materials comprising about 3 to 25% by weight acrylic resin and about 75 to 97% by weight polycarbonate.

The invention is further directed to an improved electrographic process which comprises the steps of negatively charging and image-wise exposing to light a photographic plate comprising a conductive substrate, a charge generating layer and a charge transport layer wherein the charge transport layer includes a tri-aryl pyrazoline compound and a mixture of binder materials comprising about 3 to 25% by weight acrylic resin and about 75 to 97% by weight polycarbonate.

The invention is further directed to an improved photoconductive composition comprising a tri-aryl pyrazoline and a mixture of binder materials comprising about 3 to 25% by weight acrylic resin and about 75 to 97% by weight polycarbonate.

PREFERRED EMBODIMENTS

Background and experience in the subject matter of the instant invention has shown that in any given photoconductive environment, depending to a certain extent upon the nature of the active charge transport material and more particularly upon the amount of active charge transport material admixed with the mixture of binder materials, as well as upon the charge level to which the surface is exposed, the nature of the toner material, the nature of the carrier, etc., surprisingly improved results are obtained when essentially any mixture ratio of an acrylic resin to a polycarbonate is added to the charge transport layer of a layered electrophotographic plate comprising a conductive substrate, a charge generating layer and a charge transport layer. Thus, for instance, as compared to a charge transport layer which contains only a polycarbonate binder material in conjunction with the active charge transport material, it has been observed that the addition of as little as about 3% by weight of acrylic resin, i.e., the mixture of binder materials comprises about 3% by weight acrylic resin and about 97% by weight polycarbonate, was sufficient to overcome substantially all of the aforementioned drawbacks and deficiencies inherent in a charge transport layer which was formulated as taught and suggested by the prior art. Such improvement is especially effective as it relates to the extent of toner filming formed on the surface of the charge transport layer.

While, as indicated above, in any given photoconductive environment any relative ratio of acrylic resin and polycarbonate binder material yields improved results as compared to the use of only a single binder material, it has been observed that particularly good results are obtained when the mixture of binder materials comprises about 3 to 25% by weight acrylic resin and about 75 to 97% by weight polycarbonate. It is preferred that the relative amount of acrylic resin and polycarbonate be about 15 to 25% by weight acrylic resin and about 75 to 85% by weight polycarbonate.

The acrylic resin compound of the mixture of binder materials which forms the binder formulation of the instant invention may be any suitable acrylic resin polymer or copolymer or substituted polymer or copolymer possessing high dielectric strength, having good insulating properties and meeting the general requirements for binder materials indicated below. Suitable acrylic resins for use in photoconductive applications are well known in the art. Examples of such acrylic resins are the polymers of acrylic acid and methacrylic acid and esters of these acids or acrylonitrile, such as poly(methylmethacrylate), poly(n-butylmethacrylate), poly(isobutylmethacrylate), etc. It has also been found that particularly suitable resins for this application are those acrylic resins sold under the Tradenames A-10, A-101, A-11, A-21, A-21LV, A-30, B-44, B-48N, B-66, B-67, B-72, B-82, B-99, C-10LV, F-10, and NAD-10, each of which is manufactured and sold by the Rohm & Hass Company.

The polycarbonate compound of the binder formulation, whether a polymer, copolymer or a substituted polymer or copolymer, may also be selected from any of a number of such compounds known to be suitable as binders for photoconductor applications. For instance, poly(4,4'-isopropylidene-dienediphenylene carbonate) may be used, as well as Lexan-125, a polycarbonate sold by the General Electric Company. Particularly good results are obtained by using polycarbonates sold by Mobay Chemical Company under the Tradenames Merlon-50 and Merlon-60, polymers derived from bisphenol-A and phosgene. Merlon-60 manifests the following structural formula:

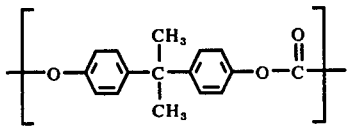

Generally, any acrylic resin or polycarbonate may be selected so long as the selected compound functions as a proper binder material in the mixture of the instant invention. That is, the selected compound must cooperate with the other binder material as well as with the photoconductor material with which it is admixed. It should also be an insulator to the extent that an electrostatic charge placed in the charge transport layer is not conducted by the binder at a rate to prevent the formation and retention of an electrostatic latent image or charge thereon. The selected binder material should also adhere to the lower layer, provide a dispersing medium for the photoconductive material and should not chemically react therewith.

While the mixture of binder materials comprising an acrylic resin and polycarbonate in accord with the instant invention may be advantageously utilized in conjunction with any photoconductive material and in any photoconductive medium, it has been found that particularly good results are obtained when the aforesaid mixture of binder materials is used in conjunction with a charge transport material in a charge transport layer of a multi-layered photoconductor. A charge transport layer is a transparent photoconductive layer which is also capable of transporting the charge generated in the separate charge generating layer and, notwithstanding the specific nature of the charge generating layer, has the further ability to accept injections of the charge, that is, to allow the charge to cross the interface between the separate charge generating and charge transport layer. The primary requirement is that the transport material, if it is an overlayer, must be substantially transparent in the wavelength region to which the electrophotographic imaging element will be exposed. However, when a layered structured is used with a transparent substrate, exposure may be accomplished through the substrate without light being required to pass through the layer of charge transport material. In this case the charge transport layer need not be nonabsorbing (transparent) in the wavelength region of use. Other applications where complete transparency is not required of the charge transport material are also known to those skilled in the art.

The active charge transport material can be either an electron or hole transport material depending upon the distinctive nature and effectiveness of the charge generating photoconductive material and the corona charge placed on the surface of the imaging element. Typical art known hole transport materials include carbazole, N-ethyl carbazole, N-isopropyl carbazole, N-phenylcarbazole, tetraphenylpyrene, 1-methylpyrene, perylene, chrysene, anthracene, tetracene, 2-phenyl naphthalene, azapyrene, fluonene, fluonone, fluorenone, 1-ethylpyrene, acetyl pyrene, 2,3-benzochyrsene, 3,4-benzopyrene, 1,4-dibromopyrene, phenyl indole, polyvinyl carbazole, polyvinyl pyrene, polyvinyl tetracene, polyvinyl perylene, and tri-aryl pyrazoline. Suitable electron transport materials include 2,4,7-trinitro-9-fluorenone (TNF), 3,4,5,7-tetranitro-9-fluorenone, dinitroanthracene, dinitroacridine, tetracyanopyrene, and dinitroanthraquinone. Additionally, any polymer which contains a moiety including the appropriate aromatic or heterocyclic charge carrier transport such as carbazole, tetracene, pyrene, or 2,4,7-trinitro-9-fluorenone, for example, will function as an active transport material. Polyesters, polysiloxanes, and epoxides, as well as block, random or graft copolymers (containing the aromatic moiety) are exemplary of the various types of polymers which could be employed as transport material.

It is preferred in the context of the instant invention that the charge transport material of the charge transport layer be a tri-aryl pyrazoline compound. The tri-aryl pyrazoline compound of the preferred charge transport layer manifests the following structural formula:

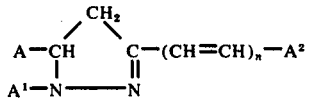

wherein $n$ is zero or one, and A, $A^1$ and $A^2$ are each aryl radicals. These compounds are described more fully in U.S. Pat. No. 3,837,851. Particularly good results have also been obtained when the tri-aryl pyrazoline compound admixed with the binder formulation of the instant invention is 1-phenyl-3[p-diethyaminostyryl]-5-[p-diethylaminophenyl]-pyrazoline manifesting the following structual formula:

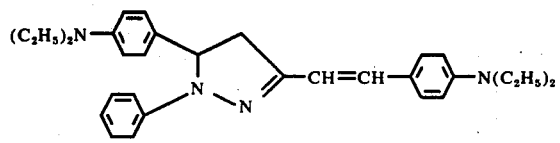

Similarly, any ratio of tri-aryl pyrazoline compound to the mixture of binder materials may be employed in the charge transport layer, the only limitation being the desired photoconductive and mechanical properties of the photoconductor such that any relative amount may be used which provides the required charge transport function and which does not disrupt the integrity of mixture of binder materials. It has, however, been found that particularly good results are obtained when one employs about 40 to 50% by weight tri-aryl pyrazoline and about 50 to 60% by weight of mixture of binder materials and the same ratio is therefore preferred in practicing the instant invention.

The charge transport material of the instant invention is fully compatible with any of a wide variety of separate charge generating layers. For example, the charge generating layer may be selenium or an alloy of selenium. It may be other inorganic materials such as compounds from groups II and VI of the periodic table, for example cadmium sulfo-selenide. Alternatively, the charge generating material may be an organic material, for example a cyanine compound such as those shown in U.S. Pat. No. 3,887,366, issued June 3, 1975, a diaszo compound such as those shown in U.S. Pat. Application Ser. No. 129,635, now abandoned, or a phthalocyanine compound. Particularly outstanding results have been obtained when the charge generating layer comprises a compound which is a methine dye derived from squaric acid. Materials of this type are discussed in U.S. Pat. Application Ser. No. 323,678, now U.S. Pat. No. 3,824,099, issued July 16, 1974. Similarly outstanding results have been realized by the use of monoazo, disazo and squaric acid derivative materials as described in U.S. Pat. Application Ser. No. 613,595, filed Sept. 15, 1975. Any of a number of other compounds known to be charge generating may also be used as are disclosed, for example, in U.S. Pat. No. 3,850,630.

Any suitable conductive substrate may be employed in the system of the present invention, its primary function being to provide support and electroconductivity for a ground plane to bleed off charge conducted to it by the rest of the structure. Typical such conductive substrates include: metallic plates, fabricated of chromium, aluminum, brass, stainless steel, copper, zinc and alloys thereof; paper treated to acquire electroconductivity. Particularly good results have been realized by the use of plastic films fabricated of aluminized Mylar (polyethyleneterephthalate) or conductive polymers. The conductive substrate may, if desired, be itself coated with an adhesive material which is to serve as the bonding agent between the conductive substrate and either the charge generating layer or the charge transport layer which is to be adhered thereto.

As explained in U.S. Pat. No. 3,837,851, while it does not matter in constructing the layered photoconductor whether the charge transport layer is on top of the charge generating layer or beneath the charge generating layer, it is generally preferred that the charge generating layer be between the conductive substrate and the charge transport layer, i.e., the charge transport layer should preferably be on top. With the charge transport layer so located on top of the charge generating layer, the electrophotographic plate should be charged negatively. When the charge transport layer is between the charge generating layer and the conductive substrate, the electrophotographic plate should be charged positively.

The formulation and construction of the layered photoconductor as it relates to the various discrete layers is not within the scope of the instant invention but the same is well known by one skilled in the art, as can be seen, for example, by reference to U.S. Pat. No. 3,837,851, or by reference to U.S. Pat. Application No. 613,595, filed Sept. 15, 1975, assigned to the assignee of the instant application.

The photoconductive material, i.e., the tri-aryl pyrazaline compound, and the mixture of binder materials which together comprise the charge transport layer, may be prepared and subsequently adhered to a lower support by any of a number of easily ascertainable means. It has been found that the triary pyrazoline compound and the mixture of binder materials are desirably mixed or blended together in any order and at any temperature, preferably at a temperature which will favor solubility, in a liquid solvent by means of any of a number of well known and conventional mixing and blending techniques such as in a paint shaker. Alternatively, the mixture of binder materials may be first dissolved in a solvent followed by the addition thereto of the tri-aryl pyrazoline compound. The resulting charge transport compositions may thereafter be solution coated upon the lower support by any well known painting or coating method including spray, dip-coating, knife-blade coating, flow-coating, electrocoating, Mayer bar drawdown, reverse roll coating, meniscus coating and the like. The solvent is added in proportions and amounts sufficient to thin the charge transport compositions to a desirable coating constituency, with the excess solvent being thereafter removed by subjecting the layer to moderate heat which also has the effect of drying and setting the coat. The drying temperature and time are easily ascertable and will depend on the particular solvent selected as well as the nature of the mixture of binder materials. Solvents of choice for preparing the charge transport layers in accordance with this invention can include a number of solvents such as benzene, toluene, acetone, 2-butanone, chlorinated hydrocarbons, e.g., methylene chloride, ethylene chloride, etc., ethers, e.g., tetrahydrofuran, or mixtures of these solvents, etc. It has been found that the charge transport layer may preferably be solvent coated from a tetrahydrofuran solution. If desired, a wetting agent may be added to the binder solution, the desirability and selection of a wetting agent is easily ascertained by one skilled in the art.

Neither the wet nor dry thickness of the charge transport layer is critical and may range from about 1 micron to 100 microns in the dry state and, although thickness outside this range are suitable, it is preferred that the dry coat have a thickness of from about 5 microns to 30 . If desired, any suitable protective overcoat may be applied upon the thus formed charge transport layer.

The following Examples further define and describe the electrophotographic plates of the instant invention. The Examples clearly outline the novel and suprising photoconductive and mechanical properties obtained when a tri-aryl pyrazoline charge transport layer has incorporated therein the mixture of binder materials comprising an acrylic resin and a polycarbonate.

It must be appreciated that while the following Examples are particularly directed to the preferred mixture ratio of binder materials in accord with this invention, experience in the subject matter of this invention has shown that, depending upon the photoconductive environment to which the charge transport layer is exposed, essentially any mixture of acrylic resin and polycarbonate binder materials may be advantageously employed to yield improved results. Therefore, the following Examples are given solely for purposes of illustration and are not to be considered in any way limitations on the invention or its scope, many variations of which are possible without departing from the spirit or scope thereof.

EXAMPLE I

A charge transport layer of a layered photoconductor containing a mixture of binder materials comprising 25% by weight acrylic resin and 75% by weight polycarbonate, and containing 50% by weight active charge transport material based on the charge transport material and mixture of binder materials, was prepared as follows: in a 22 liter round bottom flask fitted with a stirrer is added 8000 gms tetrahydrofuran (THF), 2.3 gms of Dow Corning Silicon Fluid (DC-200) wetting agent, hereinafter DC-200, and 290 gms of methyl methacrylate A-11 which is an acrylic resin Tradename manufactured and sold by the Rohm & Hass Company, hereinafter A-11. The A-11 acrylic resin had previously been dissolved in toluene to 25% by weight under agitation and heat. Under vigorous agitation, 870 gms of a polycarbonate Merlon-60, manufactured and sold by the Mobay Company, hereinafter M-60, are thereafter added to the mixture and the mixture is stir agitated until all of the M-60 is dissolved. To this solution is added 1160 gms of active charge transport material 1-phenyl-3[p-dimethylaminostyryl]-5-[p-dimethylaminophenyl]-pyrazoline, hereinafter DEASP, and the mixture is stirred until all of the DEASP is dissolved. At this point, the solution is adjusted to the desired viscosity, i.e., 76 cps, with 1 No. Brockfield spindle operating at 100 RPM.

The thus formed solution was thereafter meniscus coated upon a prepared layered structure which had been previously formed by sequential coatings upon a substrate as follows: a 3 mil Mylar (polyethyleneterephthalate) having an aluminum coating on one surface serves as the conductive substrate. The aluminum coating provides a conductive substrate. A polyester adhesive material was coated on the aluminum surface of the conductive substrate. Overlying and solution coated onto the adhesive layer is a charge generating layer of chlorodiane blue, coated from about a 0.5% by weight dye solution in about a 50%:25%:25% by weight tetrahydrofuran/ethylenediaminen/butylamine. The charge generating layer was coated to a dry thickness of approximately 2 or 3 microns. The layered structure now forms the support upon which the above described solution is meniscus coated and oven-dried to a thickness of approximately 10–30 microns.

The photoconductive element which is formed as described above is thereafter tested to determine the extent of toner film which forms upon its surface. The testing procedure is carried out as follows: The photoconductive element is negatively charged in the dark to a potential of about 800 volts by means of a corona discharge with the transfer current adjusted to approximately 175uA. The transfer current is the current obtained from the power supply source minus the current going to the corona housing. The surrounding temperature is maintained at 75° F and at 50% relative humidity. The charged element is then image-wise exposed to obtain a latent electrostatic image upon the surface, after which the light-exposed surface is magnetic-brush developed by subjecting the photoconductive surface to a flow rate of 147 gms/in/sec. of positively charged toner material passing through a mechanical gap of 10/1000$^{th}$ of an inch.

Subsequent to cleaning the toner material off the photoconductive surface, and after repeating the foregoing for the purpose of producing any given number of copies, for this Example 10,000, the extent of toner film formed and remaining upon the photoconductive surface was established as follows: Prior to exposure to light, the newly prepared photoconductive element was scanned at one known location, in its 11 inch direction, by means of a photoelectric cell for the purpose of measuring the light reflectance from such an unexposed element. This measurement generated a baseline on an automatic plotting graph. Thereafter, the photoconductive element was image-wise exposed and a specified number of copies produced, after which the reflectance was again measured at the same location, also by scanning across the 11 inch direction. This subsequent measurement generated a second line on the automatic plotting graph and the difference between the two lines was measured and converted to square inches. This measured difference, expressed in square inches, was then compared to a previously determined acceptable level of toner film formation, corresponding to 18 square inches, by the method above described, and such a level therefore serves a reference point in this particular photoconductive environment.

Following the above procedure, the total square inches of toner film observed was 10 square inches after the production of 10,000 copies.

EXAMPLE 2

Example 1 was repeated except that the amount of toner material flowing across the photoconductive surface was 172 gm/in/sec.. sec.. The total square inches of toner film observed was 12 square inches after the production of 7,500 copies.

EXAMPLE 3

Example 2 was repeated except that now the transfer current was set at 100 uA and the total square inches of toner film observed was 11 square inches after the production of 15,000 copies.

EXAMPLE 4

Example 1 was repeated except that now the transfer current was set at 125 uA, the amount of toner material flowing across the photoconductive surface was 181 gms/in/sec. and the surrounding temperature was raised to 90° F at 8% relative humidity. It was observed now that the total square inches of toner film was 11 square inches after production of 9,000 copies.

EXAMPLE 5

Example 4 was repeated at the same elevated temperature except that the transfer current was set at 140 uA and the amount of toner material flowing across the photoconductive surface was 165 gms/in/sec.. The total square inches of toner film observed under these conditions was now shown to be 24 inches after production of 12,500 copies.

EXAMPLE 6

A charge transport layer containing a mixture of binder materials comprising 15% by weight acrylic resin and 85% by weight polycarbonate and containing 50% by weight active charge transport material, based on the charge transport material and mixture of binder materials, was prepared according to the procedure set forth in Example by mixing 8000 gms THF, 2.3 gms DC-200, 174 gms toluene, 986 gms of M-60 and 1160 gms DEASP charge transport material.

The resulting photoconductive element, when prepared in accord with Example 1 and measured for toner film under the parameters of Example 1, showed that the total square inches of toner film was 28 square inches after the production of 5,000 copies.

EXAMPLE 7

Example 6 was repeated except that the transfer current was set at 100 uA and the amount of toner material flowing across the photoconductive surface was 172 gms/in/sec.. The total square inches of toner film observed under these conditions was 31 square inches after the production of 5,000 copies.

EXAMPLE 8

Example 6 was repeated except that the transfer current was set at 145 uA, the amount of toner film flowing across the photoconductive surface was 160 gms/in/sec. and the temperature was raised to 90° F at 8% relative humidity. Under these conditions it was observed that that total square inches of toner film was 52 square inches after production of 10,000 copies.

EXAMPLE 9

A charge transport layer containing a mixture of binder materials comprising 10% by weight acrylic resin and 90% by weight polycarbonate, and containing 50% by weight active charge transport material based on the charge transport material and mixture of binder materials, was prepared according to the procedure of Example 1 by mixing 8000 gms THF, 2.3 gms DC-200, 116 gms A-11, dissolved in toluene to 25% by weight, 508 gms toluene, 1044 gms M-60 and 1160 gms DEASP charge transport material.

The photoconductive element was prepared and tested for toner film formation under the same conditions as set forth in Example 1. It was observed not that the total square inches of toner film was 34 square inches after production of 5,000 copies.

EXAMPLE 10

The procedure of Example 1 was substantially repeated except that now the charge transport layered was prepared to contain only a polycarbonate binder material, that is, no acrylic resin was added. The charge transport layer now comprised 50% by weight DEASP and 50% by weight M-60, the M-60 polycarbonate being the only binder material used. The solution was prepared by mixing 8000 gms THF, 2.1 gms DC-200, 852 gms toluene, 1120 gms of M-60 and 1120 gms of DEASP charge transport material. The solution was thereafter meniscus coated into a support as in Example 1, and subjected to the testing procedure of Example 1 except that the transfer current was set at 100 uA and the amount of toner material flowing across the photoconductive surface was at 172 gms/in/sec.. It was observed that the total square inches of toner film formed under these conditions was 39 square inches after the production of 5,000 copies.

EXAMPLE 11

Example 10 was repeated except that the amount at toner material flowing across the photoconductive surface was 195 gms/in/sec.. and under these conditions it was observed that the total square inches of toner film was 22 square inches after the production of 5,000 copies.

EXAMPLE 12

Example 10 was repeated but with the amount of toner material flowing across the photoconductive surface set at 180 gms/in/sec. and it was observed that the total square inches of toner film was 38 square inches after the production of 5,000 copies.

EXAMPLE 13

Example 10 was repeated with another toner material mix and it was observed that the total square inches of toner film was again 39 square inches after the production of 5,000 copies.

EXAMPLE 14

Example 10 was repeated with yet another toner material mix and the total square inches of toner film was observed to be 24 square inches after the production of 5,000 copies.

What is claimed:

1. An improved layered electrophotoconductive imaging element containing a conductive substrate, a charge generating layer and a charge transport layer, said charge transport layer comprising a tri-aryl pyrazoline compound having the formula:

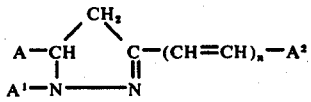

wherein n is zero or one, and A, A and $A^2$ are each aryl radicals, the improvement comprising:

said charge transport layer including said triaryl pyrazoline compound and a mixture of binder materials comprising about 10 to 25% by weight acrylic resin and about 75 to 90% by weight polycarbonate.

2. The layered electrophotographic imaging element of claim 1 wherein the mixture of binder materials comprises about 15 to 25% by weight acrylic resin and about 75 to 85% by weight polycarbonate.

3. The layered electrophotographic imaging element of claim 1 wherein the relative amount of tri-aryl pyrazoline compound and mixture of binder materials is about 40 to 50% by weight tri-arylpyrazoline compound and about 50 to 60% by weight mixture of binder materials.

4. The layered electrophotographic imaging element of claim 1 wherein the tri-aryl pyrazoline compound is 1-phenyl-3-[p-dietylaminostyryl]-5-[p-diethylaminophenyl]-pyrazoline.

5. An improved electrophotographic process comprising the steps of negatively charging and image-wise exposing to light an electrophotographic plate comprising a conductive substrate, a charge generating layer and a charge transport layer, said charge transport layer comprising a tri-aryl pyrazoline compound having the formula:

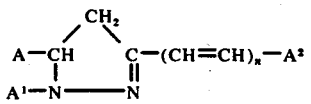

wherein $n$ is zero or one, and A, $A^1$ and $A^2$ are each aryl radicals, the improvement comprising:

utilizing a charge transport layer including said triaryl pyrazoline compound and a mixture of binder materials comprising about 10 to 25% by weight acrylic resin and about 75 to 90% by weight polycarbonate.

6. The electrophotographic process of claim 5 wherein the mixture of binder material comprises about 15 to 25% by weight acrylic resin and about 75 to 85% by weight polycarbonate.

7. The electrophotographic process of claim 5 wherein the relative amount of tri-aryl pyrazoline compound and mixture of binder materials is about 40 to 50% by weight tri-aryl pyrazoline compound and about 50 to 60% by weight mixture of binder materials.

8. The electrophotographic process of claim 5 wherein the tri-aryl pyrazoline compound is 1-phenyl-3-[p-diethylaminostryrl]5-[p-diethylaminophenyl]-pyrazoline.

9. An improved charge transport layer for use in a photoconductive system comprising a tri-aryl pyrazoline compound having the formula:

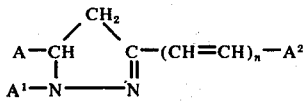

wherein $n$ is zero or one, and A, $A^1$ and $A^2$ are each aryl radicals, the improvement comprising:

incorporating with said tri-aryl pyrazoline compound a mixture of binder materials comprising about 10 to 25% by weight acrylic resin and 75 to 90% by weight polycarbonate.

10. The charge transport layer of claim 9 wherein the mixture of binder material comprises about 15 to 25% by weight acrylic resin and about 75 to 85% by weight polycarbonate.

11. The charge transport layer of claim 9 wherein the relative amount of tri-aryl pyrazoline compound and mixture of binder materials is about 40 to 50% by weight tri-aryl pyrazoline compound and the about 50 to 60% by weight mixture of binder materials.

12. The charge transport layer of claim 9 wherein the tri-aryl pyrazoline compound is 1-phenyl-3-[p-diethylaminostyryl]-5-[p-diethylaminophenyl]-pyrazoline.

* * * * *

UNITED STATES PATENT AND TRADEMARK OFFICE

CERTIFICATE OF CORRECTION

PATENT NO. : 4,030,923

DATED : June 21, 1977

INVENTOR(S) : Donald Lester Krause
Kenneth Dale Presley

It is certified that error appears in the above-identified patent and that said Letters Patent are hereby corrected as shown below:

Column 2, line 63, "3,549,362" should read --3,549,360--.

Column 3, line 36, "tht" should read --that--.

Column 8, line 18, after "Application" should read -- Ser. --.

Column 8, line 22, "pyrazaline" should read --pyrazoline--.

Column 8, line 26, "triary" should read --tri-aryl--.

Column 8, line 43, "compositions" should read --composition--.

Column 8, line 66, after "30" should read --microns--.

Column 8, line 64, "are" should read --is--.

Column 9, line 5, "suprising" should read --surprising--.

Column 9, line 50, "No." should read --#--.

Column 9, line 67, "or 3" should read --to 3--.

Column 10, line 10, "uA" should read --μA--.

Column 10, line 20, "10/1000th" should read --40/1000th--.

Column 10, line 53, "sec.. sec.." should read --sec.--.

Column 10, line 59, "uA" should read --μA--.

Column 10, line 65, "uA" should read --μA--.

Column 11, line 8, "sec.." should read --sec.--.

UNITED STATES PATENT AND TRADEMARK OFFICE

CERTIFICATE OF CORRECTION

PATENT NO. : 4,030,923

DATED : June 21, 1977

INVENTOR(S) : Donald Lester Krause
Kenneth Dale Presley

It is certified that error appears in the above-identified patent and that said Letters Patent are hereby corrected as shown below:

Column 11, line 10, after "24" should read --square--.

Column 11, line 20, after "Example" should read --1--.

Column 11, line 31, "uA" should read --μA--.

Column 11, line 33, "sec.." should read --sec.--.

Column 11, line 39, "uA" should read --μA--.

Column 11, line 59, "not" should read --now--.

Column 12, line 8, "uA" should read --μA--.

Column 12, line 10, "sec.." should read --sec.--.

Column 12, line 18, "sec.." should read --sec.--.

Column 12, line 54, "and$^1$A,A" should read --and A, A$^1$--.

Column 12, line 55, "triaryl" should read --tri-aryl--.

Column 12, line 68, "tri-arylpyrazoline" should read --tri-aryl pyrazoline--.

Column 13, line 5, "[p-dietylaminostryl]" should read --[p-diethylaminostryl]--.

Column 13, line 21, "*n*" should read --n--.

Column 13, line 23, "triaryl" should read --tri-aryl--.

UNITED STATES PATENT AND TRADEMARK OFFICE

CERTIFICATE OF CORRECTION

PATENT NO. : 4,030,923

DATED : June 21, 1977

INVENTOR(S) : Donald Lester Krause
Kenneth Dale Presley

It is certified that error appears in the above-identified patent and that said Letters Patent are hereby corrected as shown below:

Column 14, line 5, "]5" should read --]-5--.

Column 14, line 16, "*n*" should read --n--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*